US011028715B2

(12) United States Patent
Dierksmeier

(10) Patent No.: US 11,028,715 B2
(45) Date of Patent: Jun. 8, 2021

(54) REDUCED LEAKAGE AIR SEAL

(71) Applicant: Rolls-Royce North American Technologies Inc., Indianapolis, IN (US)

(72) Inventor: Douglas David Dierksmeier, Franklin, IN (US)

(73) Assignee: Rolls-Royce North American Technologies, Inc., Indianapolis, IN (US)

( * ) Notice: Subject to any disclaimer, the term of this patent is extended or adjusted under 35 U.S.C. 154(b) by 269 days.

(21) Appl. No.: 16/149,499

(22) Filed: Oct. 2, 2018

(65) Prior Publication Data

US 2020/0102847 A1 Apr. 2, 2020

(51) Int. Cl.
*F01D 11/02* (2006.01)
*F01D 9/04* (2006.01)

(52) U.S. Cl.
CPC ..... *F01D 11/025* (2013.01); *F01D 9/04* (2013.01); *F05D 2220/321* (2013.01); *F05D 2220/323* (2013.01); *F05D 2240/10* (2013.01); *F05D 2240/55* (2013.01)

(58) Field of Classification Search
None
See application file for complete search history.

(56) References Cited

U.S. PATENT DOCUMENTS

| | | | | |
|---|---|---|---|---|
| 4,023,919 | A * | 5/1977 | Patterson | F01D 11/18 415/134 |
| 7,249,769 | B2 * | 7/2007 | Webster | F01D 11/025 277/410 |
| 9,732,622 | B1 * | 8/2017 | Mills | F16J 15/3448 |
| 2005/0285345 | A1 * | 12/2005 | Webster | F01D 11/025 277/355 |
| 2012/0275898 | A1 | 11/2012 | McCaffrey et al. | |
| 2016/0237842 | A1 | 8/2016 | Blaney et al. | |
| 2016/0273376 | A1 | 9/2016 | Rioux et al. | |
| 2018/0030986 | A1 * | 2/2018 | Sen | F04D 27/002 |
| 2018/0202307 | A1 | 7/2018 | Ortiz | |

FOREIGN PATENT DOCUMENTS

EP 3351740 A1 7/2018

* cited by examiner

*Primary Examiner* — Ninh H. Nguyen
*Assistant Examiner* — Jason Fountain
(74) *Attorney, Agent, or Firm* — Shumaker & Sieffert, P.A.

(57) ABSTRACT

An air seal for a jet turbine engine with an upper stator, lower stator and finned turbine disk. The thermal expansion of the stators may be regulated by a control ring, which has a lower rate of thermal expansion that the stators, to prevent rubbing between the stator and fins.

17 Claims, 8 Drawing Sheets

REDUCED LEAKAGE AIR SEAL

BACKGROUND

In jet turbine engines an air seal is used to separate hot post combustion gasses which drive the turbine from colder cooling air which prevents over heating of the engine components. One type of such seal is the knife seal. Knife or labyrinth seals are generally made up of a stator or ring, and a series of knives, fins or baffles normal to the stator with a very small clearance between them. This produces a torturous flow path for the air, preventing leakage.

Knife seals may be mounted horizontally within a turbine engine allowing for the stators to be mounted to support structures and the baffles mounted to the turbine disks. Two concentric stators may be mounted with an inner and outer stator with the turbine disk having a set of baffles for each. The stator portions of the seal are often extensions of the structural support.

To function well, knife seals require the very small clearance between the stator and baffle or fin to be maintained. Dissimilar thermal expansion of the stator/stator support and the turbine disk can be detrimental to the function of the seal, as this can lead to rubbing between the stator and the fins/baffles. The rubbing can result in damage of the stator and/or fins and reduce the efficiency of the seal. The difference of expansion between the stator and the fins is often accounted for by increasing the distance between the inner and outer stator allowing the disk to expand and contract while preventing rubbing. This extra clearance, although small, itself can reduce the efficiency of the seal. Thus it is advantageous for an air seal to expand and contract with the disk while preventing rubbing and maintaining the small clearance between both stators and their respective sets of baffles during the majority of engine operations.

SUMMARY

According to some aspects of the present disclosure, a reduced leakage seal for a gas turbine may have a control ring with a radially outward facing control surface and a radially inward facing control surface. The control ring may be coaxial with an axis and have a thermal expansion time constant. The seal may also have an outer ring with a radially inward facing outer stator and a radially inward contact surface cooperating with the outward radial control surface limiting the radial inward position of the outer ring with respect to the control ring. The outer ring may have a second thermal expansion time constant. The seal may also include an inner ring with a radially outward facing inner stator and a radially outward contact surface cooperating with the radially inward control surface limiting the radial outward position of the inner ring with respect to the control ring. The inner ring may have a third thermal expansion time constant. The seal may include a plurality of alignment restraints which restrict axial translation of the control ring, outer ring and inner ring with respect to one another. The thermal expansion time constant of the control ring is greater than the second thermal expansion time constant of the outer ring.

According to another aspect the seal may further include a rotating structure with an axially extending arm with a first set of outward facing knives and a second set of inward facing knives, the outward facing knives axially aligned and opposing the outer stator and the inward facing knives axially aligned and opposing the inner stator, with the axially extending arm at least in part separating a first volume and a second volume. The first volume contains hot combustion gases. In addition, the thermal expansion time constant of the control ring may be greater than or equal a thermal expansion time constant of the rotating structure. The outer ring may also have a first radially extending flange in contact with at least one of the plurality of alignment restraints. The inner ring also may have a second radially extending flange in contact with at least another of the plurality of alignment restraints. The control ring, outer ring and inner ring may each be in contact with each of the others. The plurality of alignment restrains may be pins, brackets or clips. The seal may further have a rotating structure with a plurality of axially extending arms, a first of the plurality of axially extending arms may have a first set of outward facing knives, a second of the plurality of axially extending arms may have a second set of inward facing knives. The outward facing knives may be axially aligned oppose the outer stator while the inward facing knives may be axially aligned and oppose the inner stator; the axially extending arms at least in part separates a first volume and a second volume.

A gas turbine engine in accordance with the present disclosure may include, a rotor disk, a hot zone containing combustion gases, a cool zone containing cooling air (typically less than 900K), and a labyrinth seal separating the combustions gases from the cooling air in the cool zone. The labyrinth seal may include a control ring, a first stator, a second stator, first and second sets of knives oppositely disposed from each other. The first set may cooperate with the first stator and the second set may cooperate with the second stator. The control ring may have a first time constant of thermal expansion, while the first stator may have a second time constant of thermal expansion, which is less than the first time constant of the control ring. The second stator may have a third time constant of thermal expansion that may be also less than the first time constant. The rotor disk may have a fourth time constant of thermal expansion that is less than or equal to the first time constant. The first set and the second set of knives may extend axially from the rotor disk. According to another aspect, the control ring has an axial overlap with the first stator limiting the minimum radial position of the first stator with respect to the control ring. In addition to this aspect the control ring has a second axial overlap with the second stator limiting the maximum radial position of the second stator with a respect to the control ring; the axial overlap and the second axial overlap may have a tab extending axially from the control ring.

A method of controlling gaps between knives and stators in a labyrinth seal for a gas turbine engine in accordance with the present disclosure may include providing a labyrinth seal including a first stator, a second stator and a knife ring having a first set of knives interacting with the first stator and a second set of knives interacting with the second stator, varying the radius of a knife ring associated with the labyrinth as a function of time, temperature and rotational speed of the knife ring, also varying the radius of a control ring as a function of time and temperature, as well as limiting the radial contraction of the first stator as a function of the radius of the control ring during a first engine condition, and limiting the radial expansion of the second stator as a function of the radius of the control ring during a second engine condition. A first gap in the labyrinth seal may be a function of the radius of the knife ring and radial expansion of the second stator during the first engine condition and a second gap of the labyrinth seal may be a function of the radius of the knife ring and the radial contraction of the second stator during the second engine condition. The method may include the second engine condition may be a transition from idle to steady state cruise.

The method may also include the first engine condition may be a transition from steady state cruise to idle. The method may include as well, the first engine condition and second engine condition may be a transition from idle to cruise to idle. In accordance with another aspect of the method, the step of varying the radius of the control ring may involve the step of providing the control ring with a time constant of thermal expansion greater than the time constants of thermal expansion of the first stator and second stator.

BRIEF DESCRIPTION OF THE DRAWINGS

The following will be apparent from elements of the figures, which are provided for illustrative purposes.

Figure 1:
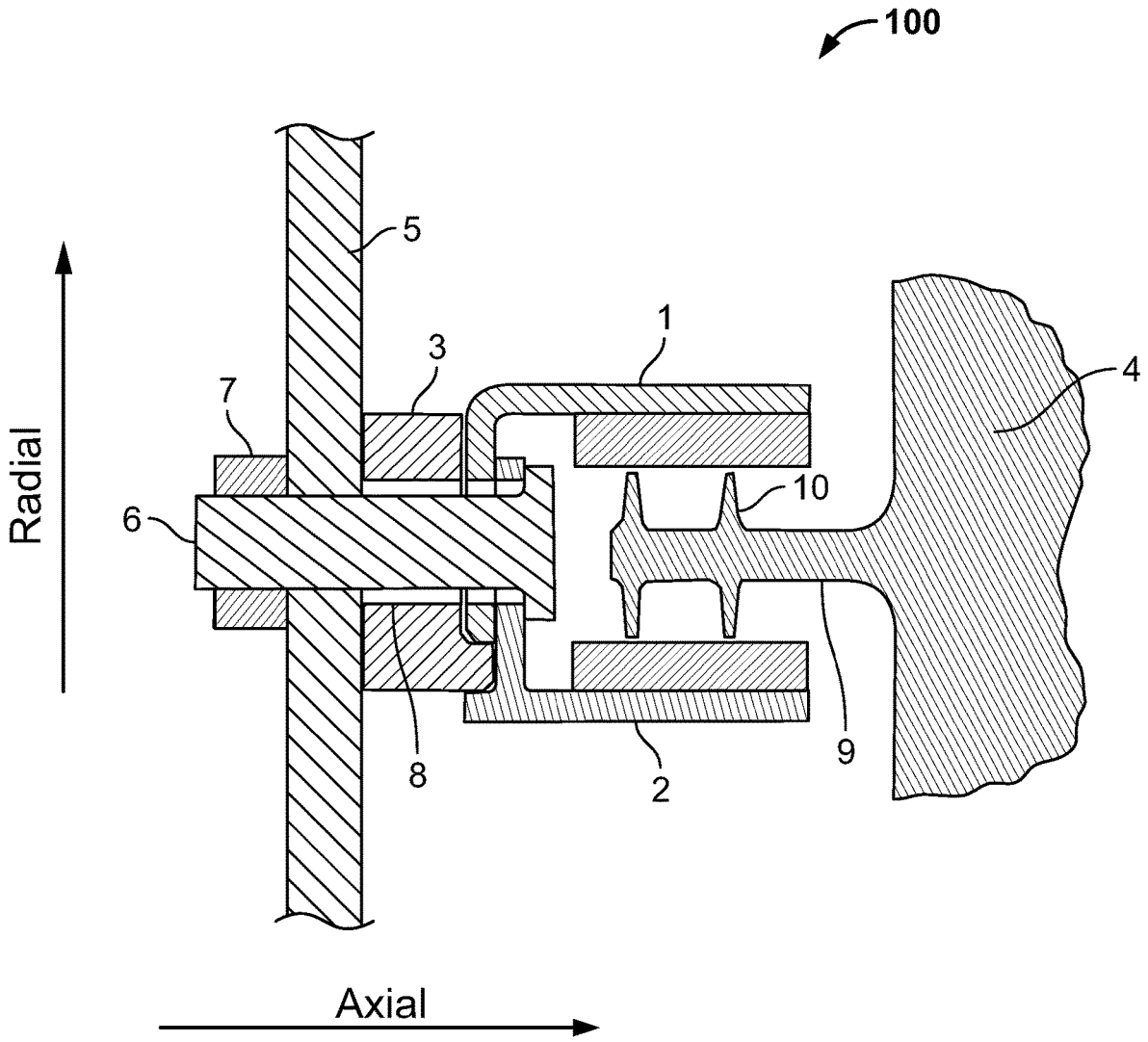
FIG. 1 depicts a cross section of a seal while engine is in cruise according to an embodiment of the present disclosure.

The present application discloses illustrative (i.e., example) embodiments. The claimed inventions are not limited to the illustrative embodiments. Therefore, many implementations of the claims will be different than the illustrative embodiments. Various modifications can be made to the claimed inventions without departing from the spirit and scope of the disclose. The claims are intended to cover implementations with such modifications.

DETAILED DESCRIPTION

For the purposes of promoting an understanding of the principles of the disclosure, reference will now be made to a number of illustrative embodiments in the drawings and specific language will be used to describe the same.

The present disclosure is directed to systems and methods for providing an air seal, particularly knife seals in a gas turbine engine.

Figure 2:
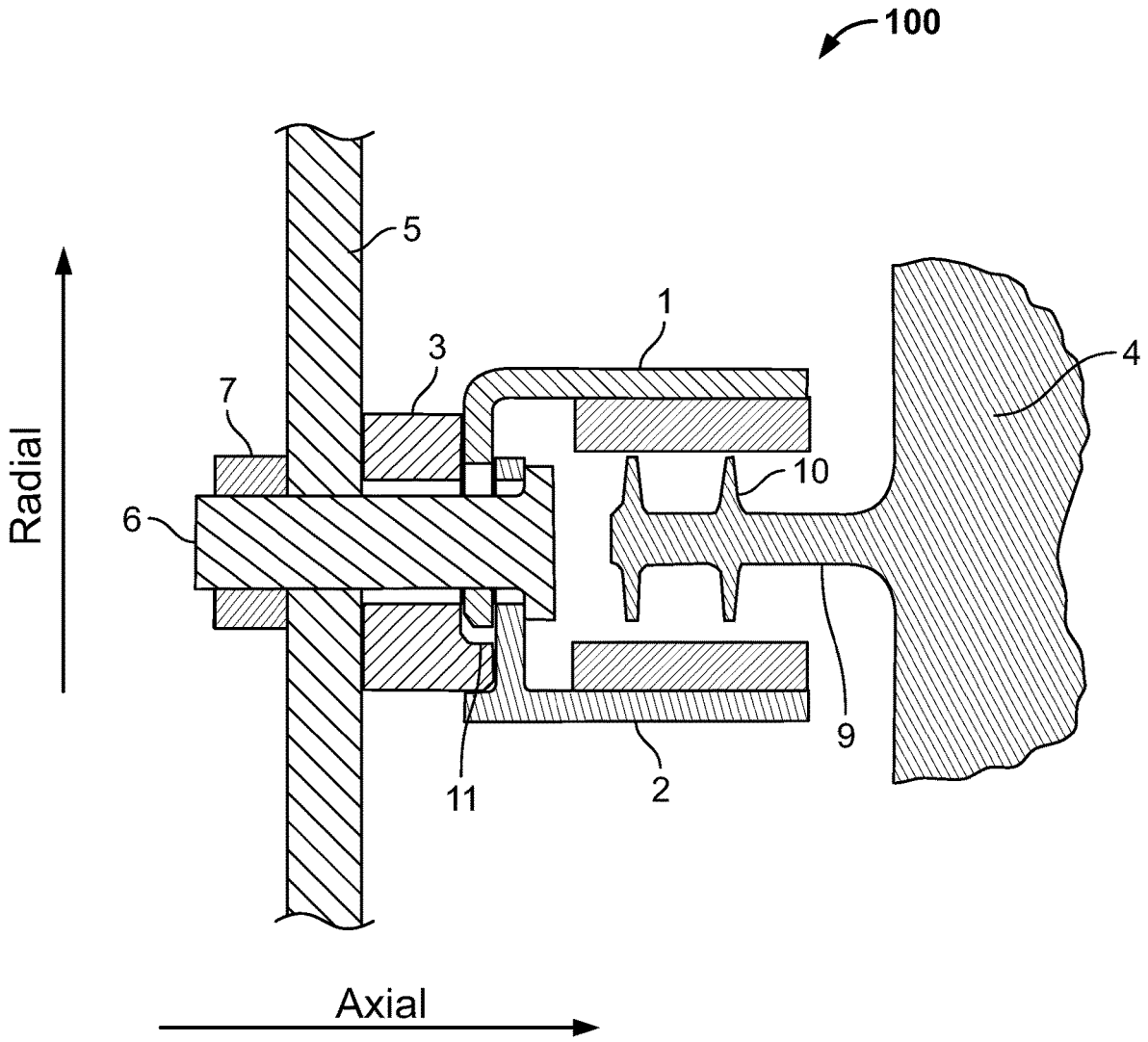
FIG. 2 depicts a cross section of the seal while engine is accelerating according to an embodiment of the present disclosure.
Figure 3:
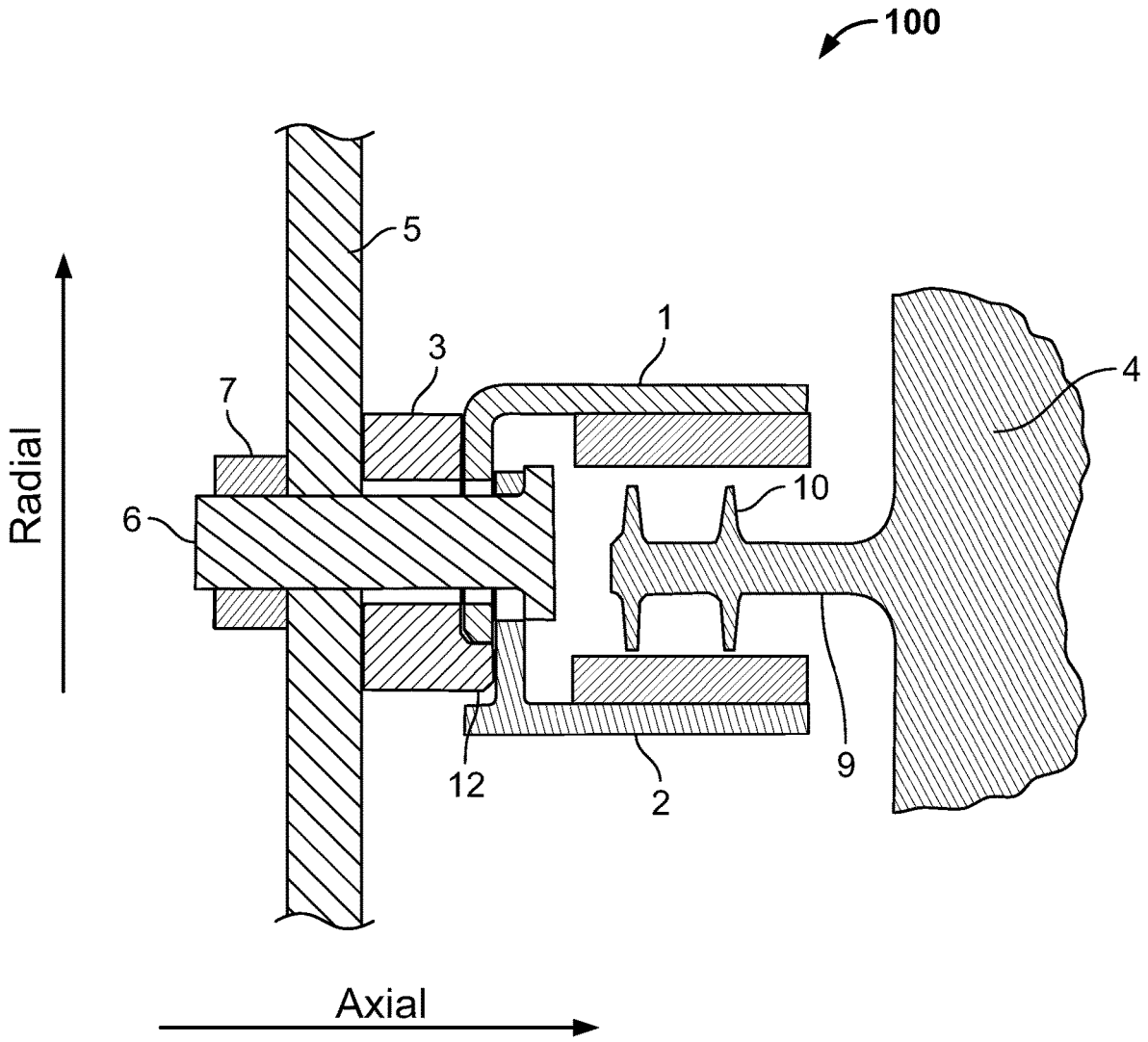
FIG. 3 depicts a cross section of the seal while engine is decelerating according to an embodiment of the present disclosure.

FIGS. 1-3 depict an embodiment of the disclosed air seal. As shown in FIG. 1 the illustrative air seal 100 has primarily four components, and upper stator 1, a lower stator 2, a control ring 3 and knifes 10 on the protrusion (arm, or knife ring) 9 extending from the turbine disk 4. Each stator may include a separate support ring for the stator. The control ring 3 may be an annular disk that encircles the center axis of the engine and separates the upper stator 1 and the lower stator 2 from the structural support 5 situated axially upstream of a turbine disk 4. The upper stator 1, lower stator 2, and control ring 3 may be held concentric to the turbine shaft by locating pins 6 distributed at a set radius around the center axis of the engine. The upper stator 1 may be an L-shaped annular disk, extending radially and axially. The radially extending portion may be situated between the control ring 3 and the lower stator 2. The lower stator 2 may also be L-shaped extending radially and axially with the radial portion between the upper stator 1 and the heads of the locator pins 6. The locator pins 6 may be fixed in place with shoulder bolts 7. A portion of the control ring 3 radially separates and may be in physical communication with both the upper stator 1, through an outward radial control surface 11, and lower stator 2, through an inward radial control surface 12. The upper stator 1, lower stator 2 and control ring 3 each have a large bore hole 8 through which the locator pin is placed. This hole is sized to provide a clearance that allows for thermal expansion and contraction during engine operation. The axially extending portions of the upper stator 1 and lower stator 2 are separated radially producing an annular gap between the stators. The turbine disk 4 has a circular protrusion 9 which extends into the annular gap between the upper and lower stators. This protrusion has a plurality of fins 10 distributed axially on both the inner and outer side of the protrusion 9. These fins combined with the upper and lower stators produce a series of knife seals which create a torturous flow path that air cannot pass. During steady-state operations, i.e. the airplane is cruising or the engine is idling, clearances between the stators and the fins are kept very small. This changes when the airplane is either accelerating or decelerating.

As shown in FIG. 2, when the airplane accelerates the increase in heat transfer leads to the stators and disk 4 expanding quickly. The control ring 3 being thicker or of a different material, expands at a rate slower than the stators. This difference produces a gap between the upper stator 1 and the control ring 3. Due to the portion of the control ring 3 in contact with the lower stator 2, the expansion rate of the lower stator 2 is arrested. This increases the space between the lower stator 2 and the fins 10 of the turbine disk 4, ensuring that no rubbing occurs and that neither the lower stator 2 or the fins 10 are damaged. The upper stator 1 continues to expand at a rate quick enough to maintain the small clearance between the upper stator 1 and the fins 10, preventing rubbing and ensuring the illustrated seal 100 continues to function. As the expansion of the control ring 3 completes the expansion of the lower stator 2 restores the small clearance between the lower stator 2 and the fins 10.

As shown in FIG. 3, during cooling the process is reversed. The stators and the turbine disk 4 contract at a higher rate the control ring 3. The difference in contraction rates produces a small gap between the control ring 3 and the lower stator 2. The control ring 3 arrests the contraction rate of the upper stator 1, increasing the distance between the upper stator 1 and the fins 10, thereby preventing rubbing between the upper stator 1 and the fins 10. The lower stator 2 contracts at a rate quick enough compared to the turbine disk 4 to maintain the small clearance between the lower stator 2 and the fins 10, ensuring the illustrated seal 100 continues to function. As the contraction of the control ring 3 completes the contraction of the upper stator 1 restores the small clearance between the upper stator 1 and the fins.

Figure 4:
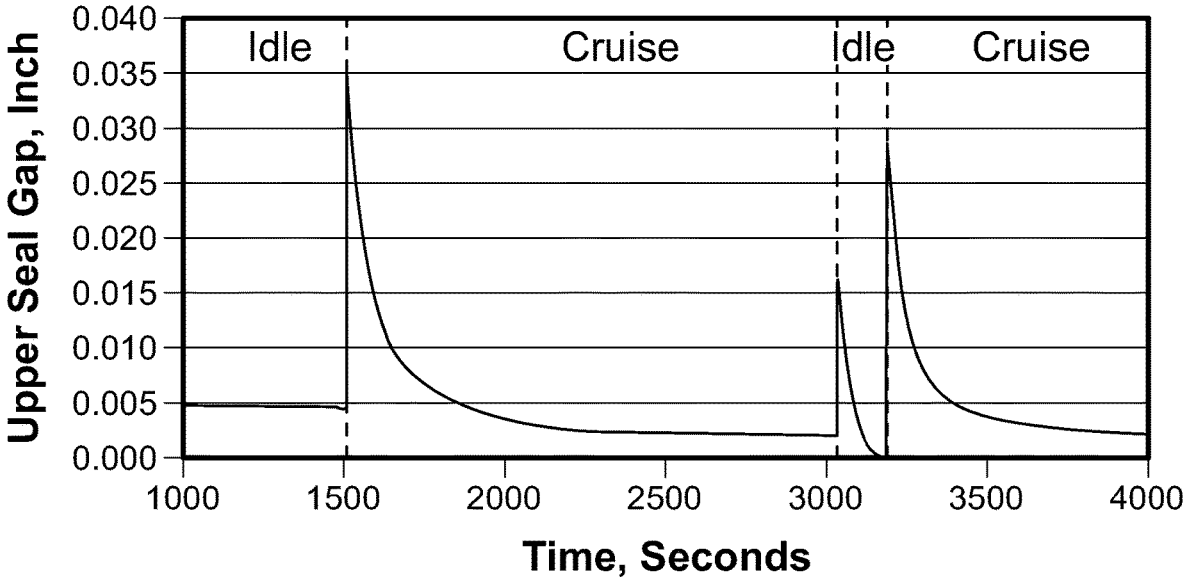
FIG. 4 depicts an illustration of the gap between the upper stator and the turbine disk while engine is operating in various modes.
Figure 5:
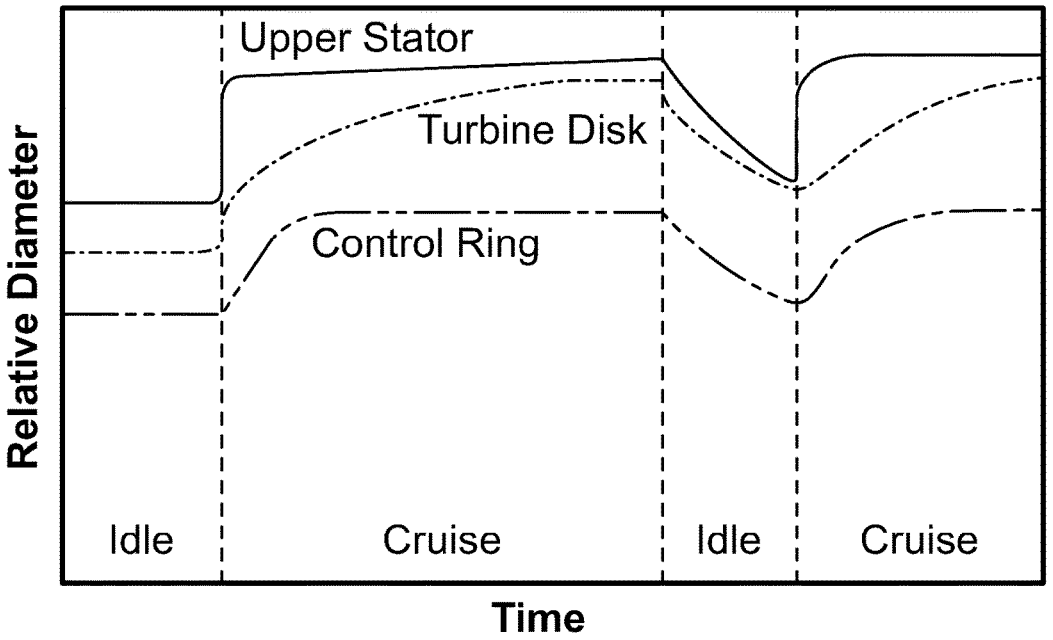
FIG. 5 depicts an illustration of the relative change in diameter of the upper stator, control ring and turbine disk while the engine is in various operating modes.

FIG. 4 qualitatively shows the seal clearances between the upper stator 1 and the turbine disk 4 during engine operation. FIG. 5 qualitatively shows the diameters of the upper stator 1, control ring 3 and turbine disk 4. The clearance is initially static while the engine is idling. When the engine powers up to cruise the upper stator 1 quickly expands to it maximum diameter, increasing the seal clearance. As the disk heats the it begins to expand reducing the size of the clearance reducing the clearance to a minimum as the expansion rate matches the rate of the structural support 5. When the engine is idled the turbine disk 4 contracts quickly as it cools. The contraction rate of the upper stator 1 is slowed by the control ring 3. This causes the clearance to temporarily increase again. The clearance decreases as the control ring 3 settles.

Figure 6:
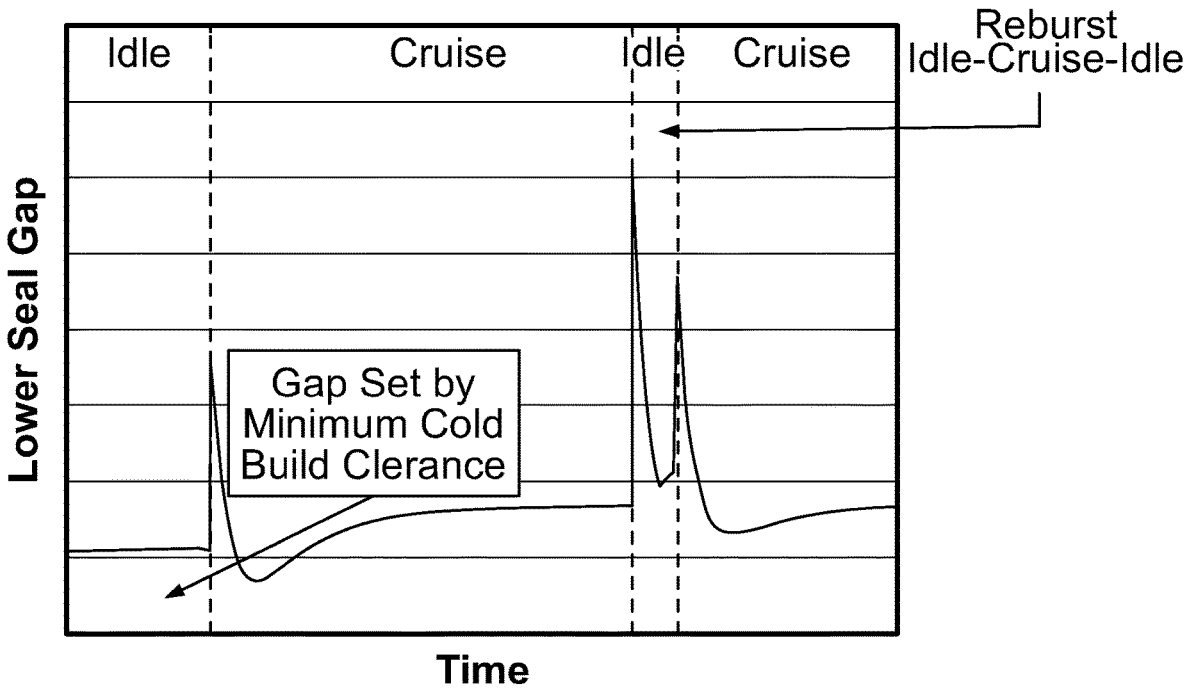
FIG. 6 depicts an illustration of the gap between the lower stator and the turbine disk while engine is operating in various modes.
Figure 7:
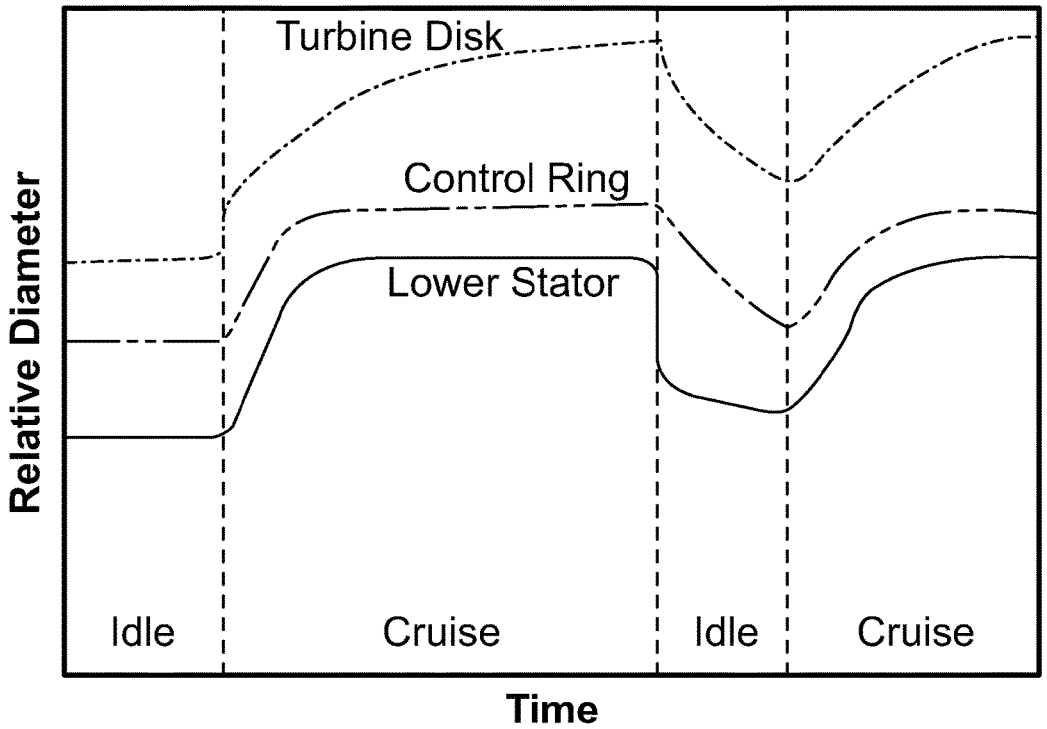
FIG. 7 depicts an illustration of the relative change in diameter of the upper stator, control ring and turbine disk while the engine is in various operating modes.

FIG. 6 qualitatively shows the seal clearances between the lower stator 2 and the turbine disk 4 during engine operation. FIG. 7 qualitatively shows the diameters of the lower stator 2, control ring 3 and turbine disk 4. The clearance is initially static while the engine is idling. When the engine powers up to cruise the lower stator 2 begins to expand its diameter but its expansion is impeded by the control ring 3. The turbine disk 4 is free to expand and initially expands at a rate much greater than the control ring 3, increasing the seal clearance. As the disk temperature nears operating temperature its expansion rate slows enabling the control ring 3 to expand at a higher rate than the disk. This reduces the size of the clearance to a minimum. As the control ring 3 reaches temperature its expansion is then halted, stopping the expansion of the lower stator 2 as well. The clearance begins to increase as the turbine continues expanding, and continues until the expansion rate of the structural support 5 and turbine disk 4 match or the turbine disk 4 reaches its final size. When the engine is idled the lower stator 2 contracts quickly as it cools to a minimum size, at a rate greater than the turbine disk 4, increasing the clearance between the two. The contraction rate of the upper stator 1 is slowed by the control ring 3. This causes the clearance to temporarily increase again. The clearance decreases as the turbine continues to contract.

Figure 9:
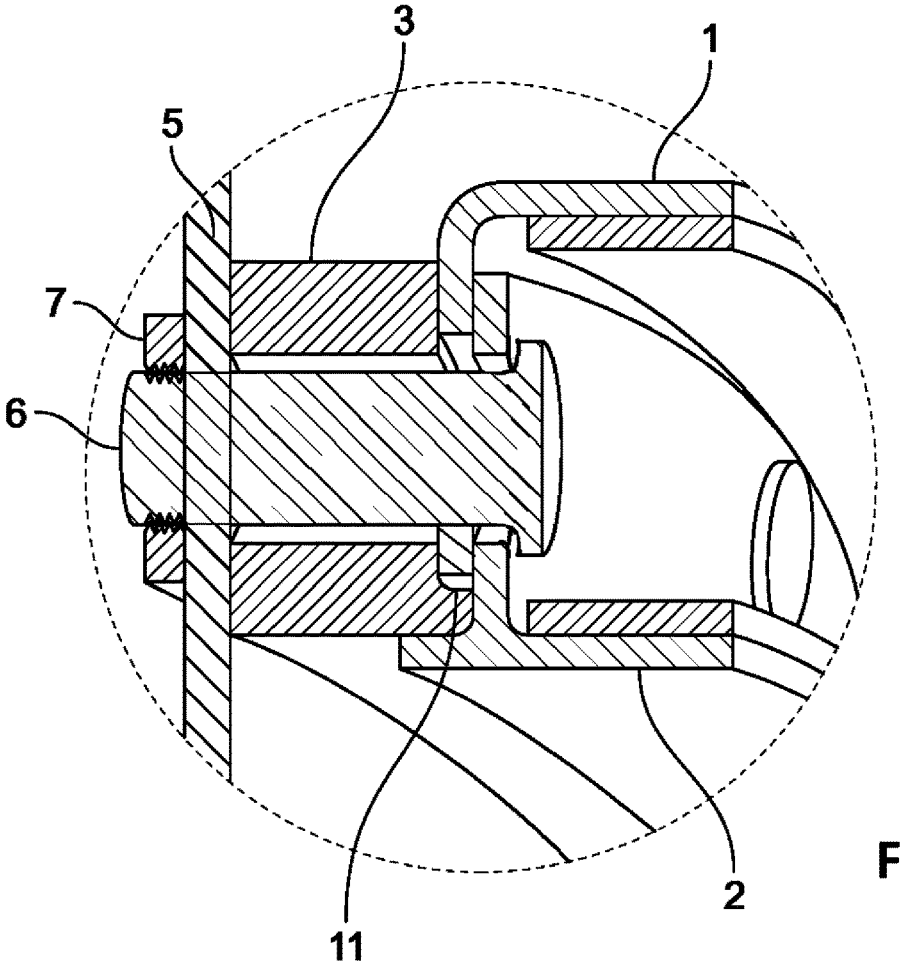
FIG. 9 is an isometric cutout of the upper and lower stators of the seal according to embodiments of the current disclosure.

FIG. 9 shows an isometric view of a cutout of the illustrated seal. Although depicted as thin and L-shaped the upper stator 1 and lower stator 2 thickness may be chosen for proper thermal expansion rates.

Figure 10:
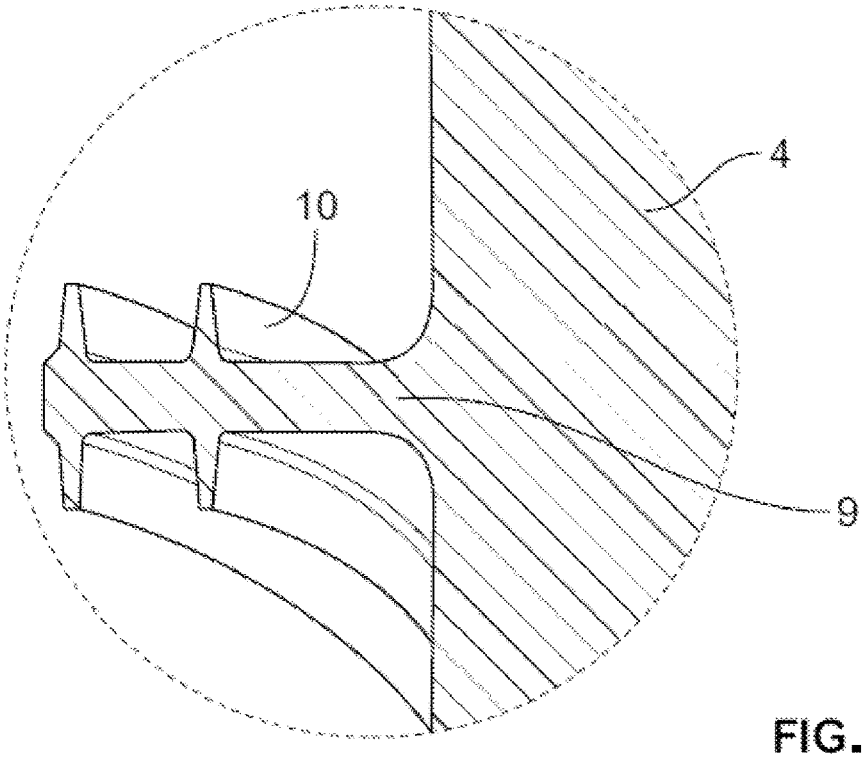
FIG. 10 is an isometric cutout of the knifes on an arm of the turbine disc according to embodiments of the current disclosure.

FIG. 10 shows an isometric view of a cutout of the turbine disk 4. Although depicted as having four fins, two on either side of the circular protrusion it can have any number chosen for ideal functioning of the knife seal.

Figure 11:
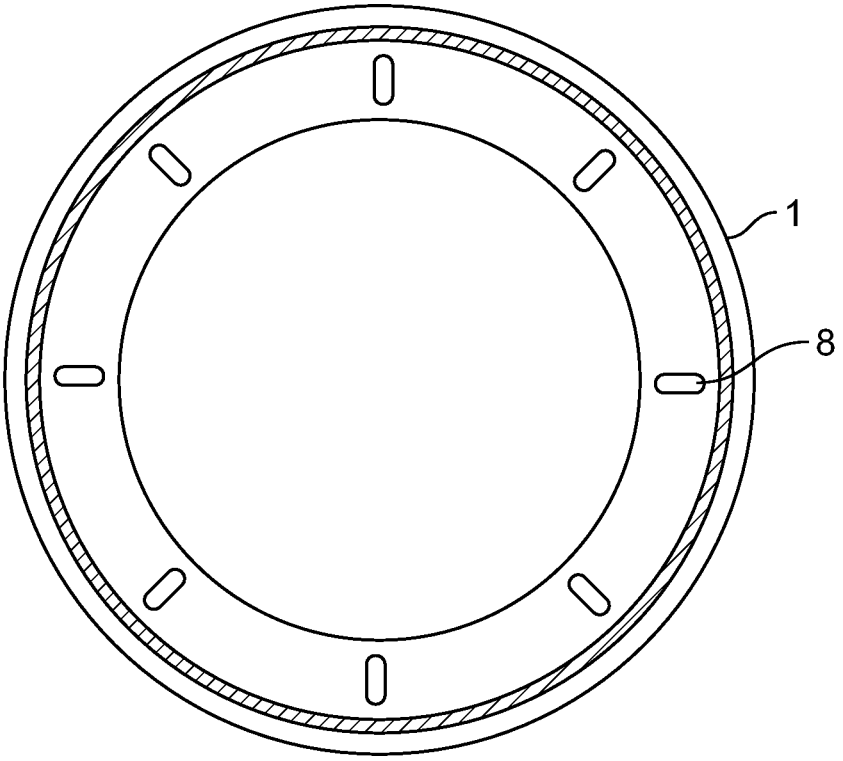
FIG. 11 depicts an axial view of the upper stator according to embodiments of the current disclosure.
Figure 12:
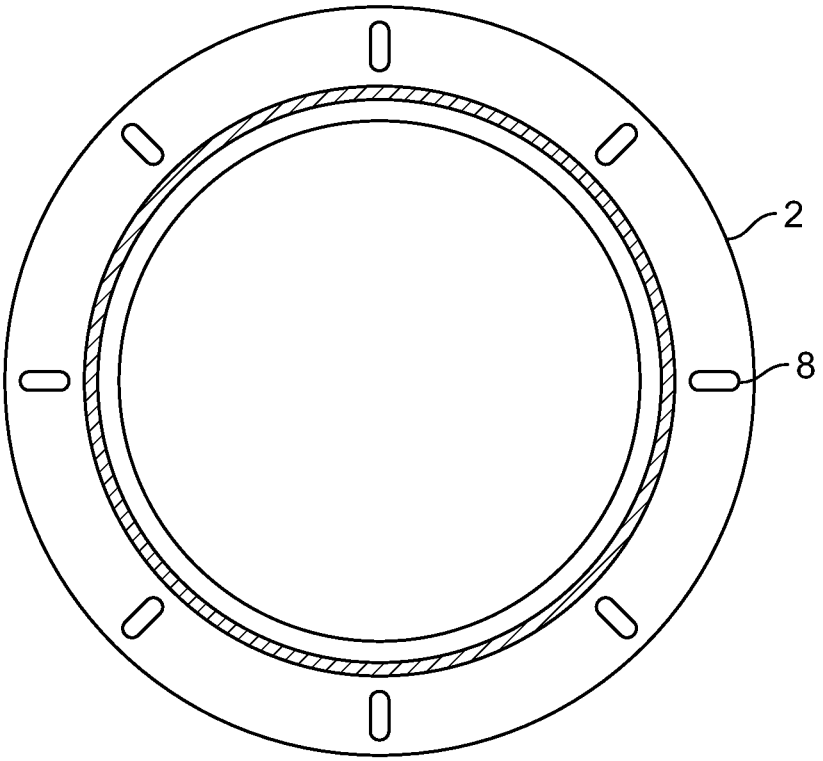
FIG. 12 depicts an axial view of the lower stator according to embodiments of the current disclosure.

FIGS. 11 and 12 depict axial views of the upper stator 1 and lower stator 2 respectively. As can be seen the stators are annular, with a plurality of bore holes. Any number of bore holes can be used, and would be based on the required number of locator pins 6 needed to ensure the stators and control ring 3 remain concentric. Although the bore holes are depicted as circular they can be radially extending slots.

Figure 8:
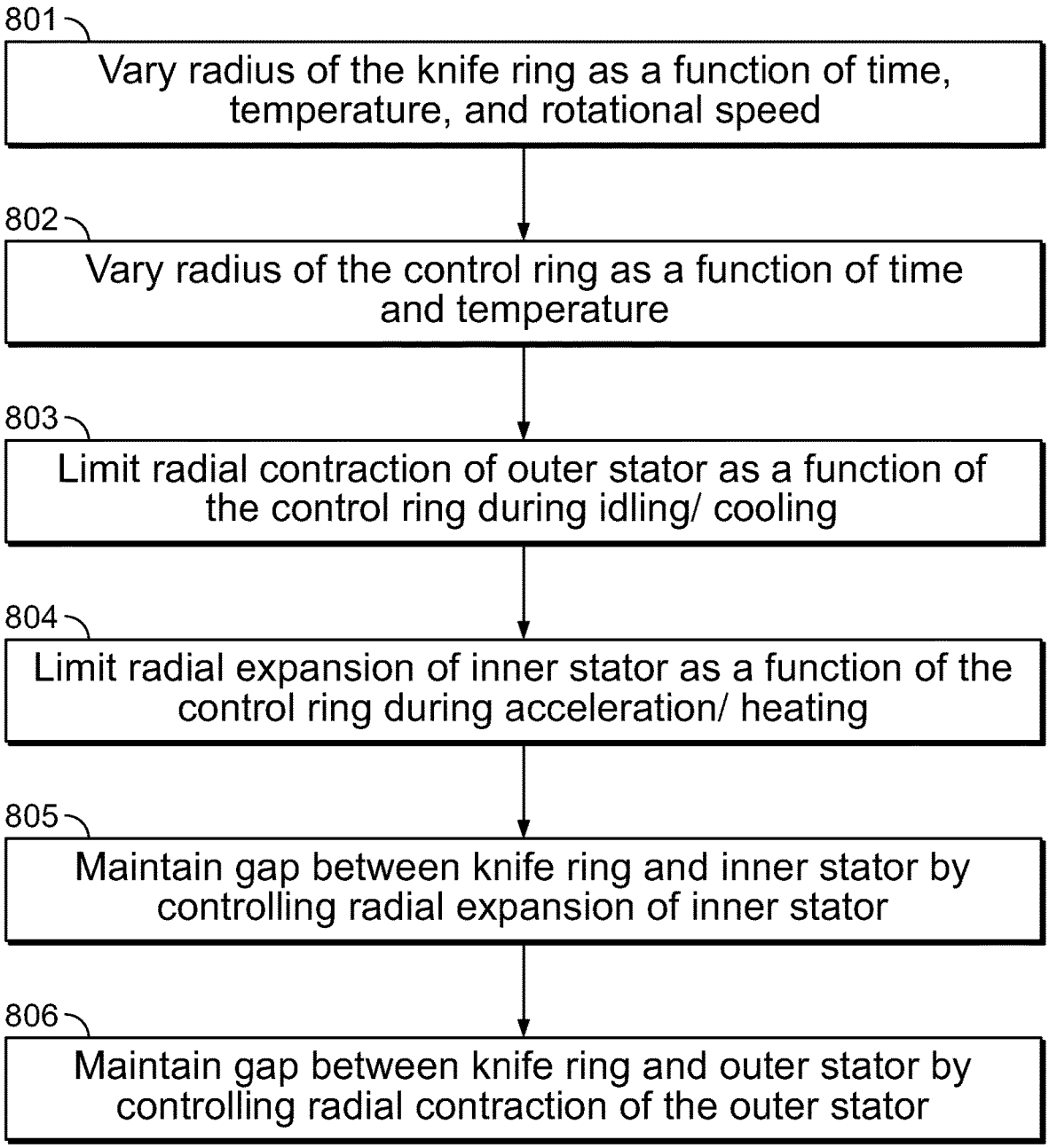
FIG. 8 is a flow chart of the method of use for the seal.

FIG. 8 is a block diagram of a method for use of the illustrated seal. Block 801 illustrates varying the radius of a knife ring associated with the labyrinth as a function of time, temperature and rotational speed of the knife ring. This may include increasing or decreasing engine power.

Block 802 illustrates varying the radius of a control ring as a function of time and temperature. This may involve ensuring a proper coefficient of thermal expansion for the control ring.

Block 803 illustrates limiting the radial contraction of the upper stator as a function of the radius of the control ring during idling or cool down of the engine. This may be done by ensuring the control ring contracts at a slower rate than the upper stator.

Block 804 illustrates limiting the radial expansion of the second stator as a function of the radius of the control ring during acceleration or heat up of the engine. This may be done by ensuring the control ring expands at a slower rate than the lower stator.

Block 805 illustrates maintaining a gap in the labyrinth seal between the knife ring and the second stator by controlling the expansion of the second stator during engine acceleration or heat up.

Block 806 illustrates maintaining a gap in the labyrinth seal between the knife ring and the upper stator by controlling the radial contraction of the first stator engine idling or cool down.

Although examples are illustrated and described herein, embodiments are nevertheless not limited to the details shown, since various modifications and structural changes may be made therein by those of ordinary skill within the scope and range of equivalents of the claims.

What is claimed is:

1. A reduced leakage seal for a gas turbine, comprising:

a control ring having a radially outward facing control surface and a radially inward facing control surface, the control ring having a thermal expansion time constant; the control ring coaxial with an axis;

an outer ring having a radially inward facing outer stator; the outer ring having a radially inward contact surface cooperating with the radially outward facing control surface limiting a radially inward position of the outer ring with respect to the control ring; the outer ring having a second thermal expansion time constant;

an inner ring having a radially outward facing inner stator, the inner ring having a radially outward contact surface cooperating with the radially inward facing control surface limiting a radially outward position of the inner ring with respect to the control ring; the inner ring having a third thermal expansion time constant;

a plurality of alignment restraints, the plurality of alignment restraints restricting axial translation of the control ring, the outer ring, and the inner ring with respect to one another; and a rotating structure comprising an axially extending arm comprising a first set of outward facing knives and a second set of inward facing knives, wherein the outward facing knives are axially aligned and opposing the outer stator and the inward facing knives are axially aligned and opposing the inner stator, and wherein the axially extending arm at least in part separates a first volume and a second volume;

wherein the thermal expansion time constant of the control ring is greater than the second thermal expansion time constant of the outer ring.

2. The seal of claim 1, wherein the first volume contains hot combustion gases.

3. The seal of claim 1, wherein the thermal expansion time constant of the control ring is greater than or equal a thermal expansion time constant of the rotating structure.

4. The seal of claim 1, wherein the outer ring comprises a first radially extending flange, the first radially extending flange in contact with at least one of the plurality of alignment restraints.

5. The seal of claim 1, wherein the inner ring comprises a second radially extending flange, the second radially extending flange in contact with at least another of the plurality of alignment restraints.

6. The seal of claim 1, wherein each of the control ring, the outer ring, and the inner ring are in contact with each of the others.

7. The seal of claim 1, wherein the plurality of alignment restrains are selected from the group consisting of pins, brackets and clips.

8. The seal of claim 7, wherein the pins comprise shoulder bolts.

9. A gas turbine engine comprising:

a rotor disk;

a hot zone containing combustion gases;

a cool zone containing cooling air, and a labyrinth seal separating the combustions gases from the cooling air in the cool zone;

the labyrinth seal comprising:

a control ring having a radially outward facing control surface and a radially inward facing control surface, wherein the control ring is coaxial with an axis, wherein the control ring has a first thermal expansion time constant;

an outer ring comprising a radially inward facing outer stator, wherein the outer ring has a radially inward contact surface cooperating with the radially outward facing control surface limiting a radially inward position of the outer ring with respect to the control ring; the outer ring having a second thermal expansion time constant;

an inner ring comprising a radially outward facing inner stator, wherein the inner ring has a radially outward contact surface cooperating with the radially inward facing control surface limiting a radially outward position of the inner ring with respect to the control ring, wherein the inner ring has a third thermal expansion time constant; and a plurality of alignment restraints, wherein the plurality of alignment restraints restrict axial translation of the control ring, the outer ring, and the inner ring with respect to each other; and a rotating structure comprising an axially extending arm comprising a first set of outward facing knives and a second set of inward facing knives, wherein the outward facing knives are axially aligned and opposing the outer stator and the inward facing knives are axially aligned and opposing the inner stator, and wherein the axially extending arm at least in part separates a first volume and a second volume;

wherein the first thermal expansion time constant of the control ring is greater than the second thermal expansion time constant of the outer ring.

10. The engine of claim 9, wherein the control ring has an axial overlap with the first stator limiting a minimum radial position of the first stator with respect to the control ring.

11. The engine of claim 10, wherein the control ring has a second axial overlap with the second stator limiting a maximum radial position of the second stator with a respect to the control ring.

12. The engine of claim 11, wherein the axial overlap and the second axial overlap comprise a tab extending axially from the control ring.

13. The engine of claim 12, wherein a plurality of pins maintains the control ring, the first stator, and the second stator concentric to a center axis of the turbine engine.

14. A method of controlling gaps between knives and stators in a labyrinth seal for a gas turbine engine comprising:

providing the labyrinth seal including:

a control ring having a radially outward facing control surface and a radially inward facing control surface, wherein the control ring has a first thermal expansion time constant; the control ring coaxial with an axis;

an outer ring having a radially inward facing outer stator, wherein the outer ring has a radially inward contact surface cooperating with the radially outward facing control surface limiting a radially inward position of the outer ring with respect to the control ring; the outer ring having a second thermal expansion time constant;

an inner ring having a radially outward facing inner stator, the inner ring having a radially outward contact surface cooperating with the radially inward facing control surface limiting a radially outward position of the inner ring with respect to the control ring; the inner ring having a third thermal expansion time constant;

a plurality of alignment restraints, the plurality of alignment restraints restricting axial translation of the control ring, the outer ring, and the inner ring with respect to one another; and a rotating structure comprising an axially extending arm comprising a first set of outward facing knives and a second set of inward facing knives, wherein the outward facing knives are axially aligned and opposing the outer stator and the inward facing knives are axially aligned and opposing the inner stator, and wherein the axially extending arm at least in part separates a first volume and a second volume;

wherein the thermal expansion time constant of the control ring is greater than the second thermal expansion time constant of the outer ring;

varying a radius of the rotating structure associated with the labyrinth as a function of time, temperature and rotational speed of the rotating structure;

varying a radius of the control ring as a function of time and temperature;

limiting radial contraction of the outer ring as a function of the radius of the control ring during a first engine condition;

limiting radial expansion of the inner ring as a function of the radius of the control ring during a second engine condition;

wherein a first gap in the labyrinth seal is a function of the radius of the rotating structure and radial expansion of the inner ring during the second engine condition and a second gap of the labyrinth seal is a function of the radius of the rotating structure and the radial contraction of the outer ring during the first engine condition.

15. The method of claim 14, wherein the second engine condition is a transition from idle to steady state cruise.

16. The method of claim 14, wherein the first engine condition is a transition from steady state cruise to idle.

17. The method of claim 14, wherein the first engine condition and second engine condition are a transition from idle to cruise to idle.

* * * * *